United States Patent [19]

Shen

[11] 4,444,256

[45] Apr. 24, 1984

[54] METHOD FOR INHIBITING SLOUGHING OF UNFRAGMENTED FORMATION IN AN IN SITU OIL SHALE RETORT

[75] Inventor: Jian C. Shen, Houston, Tex.

[73] Assignee: Occidental Research Corporation, Irvine, Calif.

[21] Appl. No.: 404,475

[22] Filed: Aug. 2, 1982

[51] Int. Cl.[3] ..... E21B 43/247; E21C 41/10

[52] U.S. Cl. ..... 166/259; 166/261; 299/2

[58] Field of Search ..... 166/291, 296, 259, 261; 299/2

[56] References Cited

U.S. PATENT DOCUMENTS

| | | | |
|---|---|---|---|
| 3,126,957 | 3/1964 | McKinnell | 166/251 |
| 3,171,482 | 3/1965 | Simm | 166/261 |
| 3,342,257 | 9/1967 | Jacobs et al. | 166/259 X |
| 3,994,343 | 11/1976 | Cha et al. | 166/261 X |
| 4,133,380 | 1/1979 | Burton et al. | 166/259 |
| 4,153,110 | 5/1979 | Ridley | 299/2 X |
| 4,192,381 | 3/1980 | Cha | 299/2 X |
| 4,192,552 | 3/1980 | Cha | 166/261 |
| 4,238,136 | 12/1980 | Ricketts | 166/259 X |
| 4,243,100 | 1/1981 | Cha | 166/259 |
| 4,263,970 | 4/1981 | Cha | 166/261 |
| 4,369,841 | 1/1983 | Cha | 166/251 |
| 4,378,841 | 4/1983 | Cha | 166/261 |

*Primary Examiner*—George A. Suchfield
*Attorney, Agent, or Firm*—Christie, Parker & Hale

[57] ABSTRACT

A method for igniting an in situ oil shale retort containing a fragmented permeable mass of formation particles containing oil shale is provided. A void space is in the retort between the top surface of the fragmented mass and the top boundary of overlying unfragmented formation. A hot ignition gas comprising oxygen is introduced into the void space to form a combustion zone across the surface of the fragmented mass. An oxygen-supplying gas is then introduced into the void space for sustaining the combustion zone and for advancing the combustion zone downwardly through the retort. The combustion zone is then extinguished and a cool inert gas is introduced into the retort to cool carbonaceous materials comprising the surface of the fragmented mass to a temperature below the self-ignition temperature of such carbonaceous materials, while leaving carbonaceous materials below the fragmented mass surface at temperatures greater than the self-ignition temperature of such materials. Introduction of the inert gas is then discontinued. Thereafter, an oxygen-supplying gas is re-introduced into the retort to ignite the carbonaceous materials below the surface of the fragmented mass for re-establishing the combustion zone in the fragmented mass and for advancing the combustion zone downwardly through the retort.

23 Claims, 1 Drawing Figure

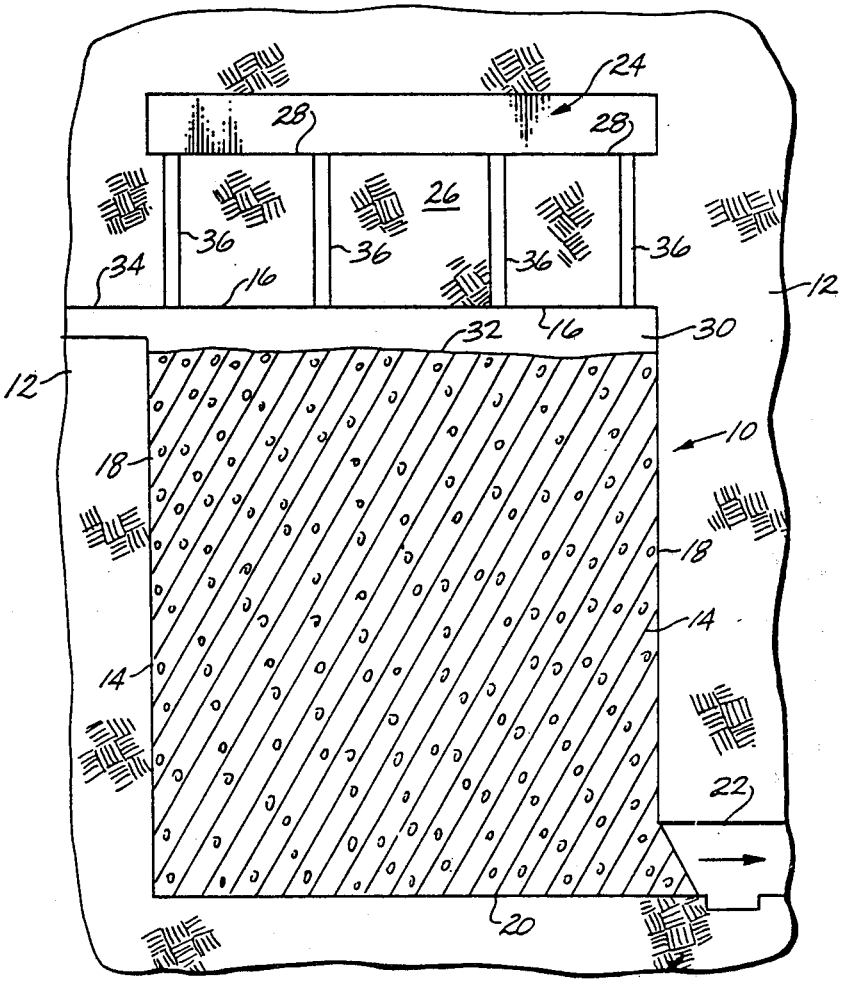
24
28
28
26
36
36
36
36
34
16
12
32
16
30
12
10
18
18
14
14
22
20

METHOD FOR INHIBITING SLOUGHING OF UNFRAGMENTED FORMATION IN AN IN SITU OIL SHALE RETORT

FIELD OF THE INVENTION

This invention relates to processing oil shale in situ and, more particularly, to a method for igniting an in situ oil shale retort that inhibits unfragmented formation from the retort roof from sloughing into the retort.

BACKGROUND OF THE INVENTION

The presence of large deposits of oil shale in the semi-arid, high plateau region of the western United States has given rise to extensive efforts to develop methods of recovering shale oil from kerogen in the oil shale deposits. It should be noted that the term "oil shale" as used in the industry is, in fact, a misnomer; it is neither shale nor does it contain oil. It is a sedimentary formation comprising a marlstone deposit with layers containing an organic polymer called "kerogen" which, upon heating, decomposes to produce liquid and gaseous products, including hydrocarbon products. It is the formation containing kerogen that is called "oil shale" herein and the liquid hydrocarbon product is called "shale oil".

A number of methods have been proposed for processing oil shale which involve either mining the kerogen-bearing shale and processing the shale on the surface or processing the shale in situ. The latter approach is preferable from the standpoint of environmental impact since the spent shale remains in place, reducing the chance of surface contamination and the requirement for disposal of solid wastes. According to both of these approaches, oil shale is retorted by heating the oil shale to a sufficient temperature to decompose kerogen and produce shale oil which drains from the rock. The retorted shale, after kerogen decomposition, contains substantial amounts of residual carbonaceous material which can be burned to supply heat for retorting.

One technique for recovering shale oil includes forming an in situ oil shale retort in a subterranean formation containing oil shale. At least a portion of the formation within the boundaries of the in situ oil shale retort is explosively expanded to form a fragmented permeable mass of particles containing oil shale. The fragmented mass is ignited near the top of the retort to establish a combustion zone. An oxygen-supplying gas such as air, air and steam, air diluted with off-gas, or air enriched with oxygen is introduced into the top of the retort to sustain the combustion zone and cause it to move downwardly through the fragmented permeable mass of particles in the retort. As burning proceeds, the heat of combustion is transferred to the fragmented mass of particles below the combustion zone to release shale oil and gaseous products therefrom in a retorting zone. The retorting zone moves from the top to the bottom of the retort ahead of the combustion zone and the resulting shale oil and gaseous products pass to the bottom of the retort for collection and removal. Recovery of liquid and gaseous products from oil shale deposits is described in greater detail in U.S. Pat. No. 3,661,423 to Donald E. Garrett.

As used herein, the term "retorting zone" refers to that portion of the retort where kerogen in oil shale is being decomposed to liquid and gaseous products, leaving residual carbonaceous material in the retorted oil shale. The term "combustion zone" refers to a portion of the retort where the greater part of the oxygen in the retort inlet mixture that reacts with the residual carbonaceous material in the retorted oil shale is consumed.

It has been found desirable in some embodiments to have an intact subterranean base of operation above the fragmented permeable mass of formation particles in an in situ oil shale retort. Such a base of operation facilitates the drilling of blastholes into underlying formation for forming the fragmented mass in the retort and facilitates ignition over the entire top portion of the fragmented mass. Additionally, having a base of operation above the fragmented mass permits control of introduction of oxygen-supplying gas into the retort, provides a location for testing properties of the fragmented mass, such as distribution of void fraction, and provides a location for evaluation and controlling performance of the retort during operation.

The base of operation is separated from the retort by a layer of unfragmented formation extending between the top boundary of the retort and the floor of such a base of operation. The layer of unfragmented formation is termed a "sill pillar" which acts as a barrier between the in situ oil shale retort and the base of operation during retorting operations. It is, therefore, important that the sill pillar remain structurally sound, both for supporting the base of operation and for preventing entry of heat and gases into the base of operation during the retorting process.

Techniques for forming an in situ oil shale retort containing a fragmented permeable mass of formation particles and having a sill pillar of unfragmented formation between the top of the fragmented mass and an overlying base of operation are described in U.S. Pat. No. 4,118,071 by Ned M. Hutchins and in U.S. Pat. No. 4,192,554 by Thomas E. Ricketts. U.S. Pat. Nos. 4,118,071 and 4,192,554 are incorporated herein by this reference. The in situ oil shale retort formed by the method disclosed in U.S. Pat. No. 4,192,554 may not be completely full of oil shale particles, i.e., there can be a void space or plenum between the upper surface of the fragmented mass of oil shale particles and the top boundary of the retort.

In retorts where no open base of operation is provided, the formation overlying the fragmented permeable mass of formation particles extends all the way to the ground surface. In such an embodiment, blastholes are drilled through the overlying formation from the ground surface.

Examples of other techniques used for forming in situ oil shale retorts are described in U.S. Pat. No. 4,043,595 by French; U.S. Pat. No. 4,043,596 by Ridley; U.S. Pat. No. 4,043,597 by French; and U.S. Pat. No. 4,043,598 by French et al, each of which is incorporated herein by this reference.

In the past, a variety of techniques have been developed for igniting oil shale particles in an in situ oil shale retort in order to establish a combustion zone. Such techniques are disclosed in U.S. Pat. No. 3,952,801 and U.S. Pat. No. 3,990,835, both by Robert S. Burton, III. According to the techniques disclosed in these patents, a hole is bored to the top of the fragmented permeable mass of oil shale particles and a burner is lowered through the borehole to the oil shale to be ignited. A mixture of combustible fuel, such as LPG (liquefied petroleum gas), diesel oil, or shale oil, and oxygen-containing gas, such as air, is burned in the burner to provide a hot ignition gas which is introduced into the fragmented mass of oil shale particles. The burning is continued until a substantial portion of the oil shale has been heated above its self-ignition temperature so that combustion of the oil shale in the fragmented mass is self-sustaining after ignition. Thereafter, the burner is extinguished and an oxygen-supplying gas is introduced into the retort to advance the combustion zone through the fragmented mass.

As mentioned above, retorts have been formed with a plenum or void space between the top surface of the fragmented mass of oil shale particles in the retort and overlying unfragmented formation.

To ignite such a retort, hot ignition gases, which can comprise oxygen if desired, can be introduced into the plenum through one or more generally vertical boreholes through overlying unfragmented formation. Alternatively, if desired, a lateral drift which communicates with the top region or surface of the fragmented mass via the plenum can be formed through a side boundary of the retort. Hot ignition gases can be introduced into the plenum through the lateral drift.

Ignition gases introduced into the plenum for heating the fragmented mass surface can also heat the bottom surface of unfragmented formation overlying the plenum. Such heating of overlying formation can result in spalling or sloughing of the formation onto the surface of the fragmented mass in the retort. For instance, hot gases used for ignition can be at a temperature of 1000° F. or more and it has been found that when unfragmented oil shale formation is heated to more than about 300° F., spalling and sloughing is enhanced.

When the material which has sloughed into the retort plenum is heated sufficiently in the presence of oxygen, it burns. Burning of such sloughed material causes increased heating of overlying unfragmented formation and results in furthering the sloughing of such formation into the retort.

When formation which has sloughed into the retort plenum burns, it consumes an indeterminable amount of oxygen in the inlet gas introduced into the retort for ignition and/or retorting. This upsets the material balance in the retort and results in operational problems.

Additionally, when a retort has a sill pillar, and a void space exists between the bottom of the sill pillar and the top surface of the fragmented mass, the sill pillar can fail if sufficient formation sloughs from its bottom. Failure of such a sill pillar can allow heat and gases to escape from the retort into the base of operation, rendering the base of operation uninhabitable and, thus, useless for control and operation of the retort.

It is, therefore, desired to provide a process for enhancing the efficient ignition of a fragmented mass in a retort, while at the same time inhibiting overlying formation from sloughing into the retort plenum.

SUMMARY OF THE INVENTION

This invention relates to a method for igniting an in situ oil shale retort in a subterranean formation containing oil shale. The retort contains a fragmented permeable mass of formation particles containing oil shale and has top, bottom, and side boundaries of unfragmented formation. A combustion zone is established in a top surface region of the fragmented mass and the leading face of the combustion zone is advanced downwardly. The combustion zone is then extinguished and a cool inert gas is introduced into the retort. The inert gas cools carbonaceous materials in the top surface region of the fragmented mass to below their self-ignition temperature, while leaving carbonaceous materials in the fragmented mass below the surface region at temperatures greater than their self-ignition temperature. Introduction of the cool inert gas is then discontinued and an oxygen-supplying gas is introduced into the retort for igniting the carbonaceous materials in the fragmented mass below the surface region to thereby re-establish the combustion zone in the retort.

BRIEF DESCRIPTION OF THE DRAWING

These and other features, aspects, and advantages of the present invention will become more apparent when considered with respect to the following description, appended claims, and accompanying drawing, wherein the drawing illustrates, semi-schematically, a vertical cross-section of an in situ oil shale retort operated in accordance with practice of principles of this invention.

DETAILED DESCRIPTION

The retort ignition process provided in accordance with practice of principles of this invention can be understood by referring to the accompanying drawing which is a semi-schematic, vertical, cross-sectional view of an exemplary in situ oil shale retort 10 prepared for ignition. The retort 10 is in a retort site in a subterranean formation 12 containing oil shale. A fragmented permeable mass of formation particles 14 containing oil shale is contained within the top boundary 16, generally vertically extending side boundaries 18, and bottom boundary 20 of the retort. The boundaries comprise unfragmented oil shale formation.

Although the retort shown is generally rectangular in horizontal cross-section, the ignition process of this invention is useful for retorts having other configurations as well.

Access to the bottom of the exemplary retort 10 is provided through a horizontal access drift or tunnel 22 at the retort's bottom. In one embodiment, the drift 22 is first formed in the subterranean oil shale formation and a portion of the formation is then removed through the drift to form an open space in the formation which defines the bottom or floor of the retort. Unfragmented oil shale above this open space is then fragmented with explosive, both to form a cavity defined by the boundaries of the retort and to substantially fill the cavity with the fragmented mass of particles 14.

Although it is preferred that the average void fraction of the fragmented mass is between about 15 percent and about 35 percent, other void fractions can also be used. Preferably, the permeability of the fragmented mass is uniform across horizontal cross-sections of the retort to promote uniformity of gas flow and inhibit gas channeling.

If desired, access to the bottom of the oil shale retort can be provided by one or more raises which extend upwardly from a lateral drift into a bottom portion of the fragmented mass.

In the exemplary embodiment of the retort 10, there is also provided an open base of operation 24 mined into the subterranean formation above the top boundary 16. The open base of operation extends across the retort and provides effective access to substantially the entire horizontal extent of such a retort. If desired, the base of operation can be deleted and access to the top of the retort can be from the ground surface or from a drift or drifts which extend either above or adjacent the retort near the side boundaries.

A sill pillar 26 of unfragmented formation remains between the fragmented mass 14 and the open base of operation 24. The top 28 of the sill pillar is the floor of the base of operation and the bottom of the sill pillar is the top boundary 16 of the retort. When no base of operation is provided, unfragmented formation can extend all the way from the top boundary of the retort to the ground surface.

In the exemplary embodiment, there is a void space 30 between the top surface 32 of the fragmented mass and the bottom surface of unfragmented formation overlying the fragmented mass, i.e., the top boundary 16 of the retort.

Ignition of the retort 10 is accomplished according to practice of principles of this invention by introducing a hot ignition gas comprising oxygen into the void space 30 for heating the top surface 32 of the fragmented mass to above the self-ignition temperature of oil shale, i.e., to above about 650°–700° F. This ignites the oil shale and forms a combustion zone across the top surface of the fragmented mass.

Introduction of the hot ignition gas is then discontinued and an oxygen-supplying gas such as air, oxygen-enriched air, air diluted with off-gas, or steam or the like is introduced into the void space while off-gas is withdrawn from the retort downstream from the combustion zone. The oxygen-supplying gas sustains the combustion zone and advances the leading face of the combustion zone downwardly to below the top surface region of the fragmented mass. This creates a heated zone in the fragmented mass extending from the fragmented mass surface to a location downstream from the leading edge of the combustion zone.

A "heated zone" as used herein is defined as that region of the fragmented mass that comprises residual carbonaceous materials that are heated to above their self-ignition temperature. The term "self-ignition temperature" as used herein is the temperature above which such carbonaceous materials will ignite upon contact with an oxygen-supplying gas. It has been found that in typical oil shale retorts, the self-ignition temperature of carbonaceous materials is about 550° F.

During both of the above mentioned ignition steps, the top boundary 16 of unfragmented formation is heated by the hot ignition gases and by burning of the fragmented mass surface. Such heating tends to enhance undesirable spalling and sloughing of formation from the top boundary into the retort.

To inhibit such sloughing, introduction of the oxygen-supplying gas into the retort is discontinued after the leading face of the combustion zone has been advanced sufficiently into the retort to provide a heated zone having a desired thickness. Discontinuing introduction of oxygen extinguishes the combustion zone and also extinguishes combustion of any overlying formation that may have sloughed into the retort and ignited.

A cool inert gas is then introduced into the void space to cool the retort top boundary. Additionally, the inert gas is provided to cool carbonaceous materials comprising the surface region of the fragmented mass, i.e., the top portion of the heated zone, and any formation that may have sloughed into the retort.

Once a desired amount of cooling has been achieved, introduction of the cool inert gas is discontinued. The amount of cooling is as desired when carbonaceous materials comprising the surface region of the fragmented mass, i.e., the top portion of the heated zone, are cooled to below their self-ignition temperature, while carbonaceous materials comprising the fragmented mass in regions below its surface, i.e., the bottom portion of the heated zone, remain at temperatures higher than their self-ignition temperature.

Oxygen-supplying gas is then re-introduced into the void space and the carbonaceous materials in the bottom portion of the heated zone are re-ignited to re-establish the combustion zone below the fragmented mass surface.

Introduction of the oxygen-supplying gas is continued to sustain the combustion zone and advance it downwardly through the retort to start retorting operations.

The surface region of the fragmented mass, including sloughed materials, remains extinguished during subsequent retorting operations and, thus, acts as an insulator to inhibit further heating of the top boundary. Additionally, because introduction of hot ignition gas was not required for re-ignition, heating of the top boundary by such hot gases does not take place.

In an exemplary embodiment of practice of the ignition process of this invention, the hot ignition gas is introduced into the void space 30 through one or more drifts 34 which extend laterally through a side boundary of the retort. Although only one such drift 34 is shown, if desired, a plurality of drifts or boreholes through the side boundaries can be used.

Alternatively, if desired, the hot ignition gas can be introduced through one or more boreholes 36 which extend from the base of operation 24 through the sill pillar 26 into the void space 30. The boreholes 36 can be blastholes used for explosively expanding unfragmented formation to form the fragmented mass or, alternatively, if desired, can be drilled in the formation after the retort is formed.

During retorting, the boreholes 36 can be used for introduction of the oxygen-supplying gas which is provided to sustain and advance the combustion zone downwardly through the fragmented mass in the retort. The drift or drifts (34) can also be used, if desired, for introduction of the oxygen-supplying gas.

Whether the hot ignition gas is introduced through the drift 34, as is described in the exemplary embodiment, or alternatively is introduced through one or more of the boreholes 36, the void space 30 acts as a plenum for distributing the ignition gas across the surface 32 of the fragmented mass. The ignition gas passes downwardly from the plenum 30, through the fragmented mass, and is withdrawn through the drift or retort outlet 22 which communicates with a lower portion of the fragmented mass.

The hot ignition gas is preferably exhaust gas supplied by combining fuel and an oxygen-supplying gas such as air in a burner and then igniting the mixture. Burners such as those termed "hot inert gas generators" sold by John Zinc Company of Tulsa, Okla., have been found to be useful in practice of this invention. Other burners such as those described in U.S. Pat. Nos. 3,952,801 and 3,990,835 by Burton can also be used, if desired. U.S. Pat. Nos. 3,952,801 and 3,990,835 are incorporated hereinabove by reference.

In one exemplary embodiment of the ignition process, a burner (not shown) is positioned in the drift 34. A fuel/air mixture is supplied to the burner and ignited to provide a hot ignition gas comprising oxygen. The ignition gas is introduced into the void space 30 for heating the surface of the fragmented mass to above the self-ignition temperature of oil shale to thereby establish the combustion zone in the retort.

At the start of the ignition process, i.e., when the hot ignition gas is first introduced into the retort, none of the oil shale at the surface of the fragmented mass is at a temperature sufficiently high to consume any oxygen in the ignition gas. Thus, the retort off-gas that results from initial heating of the oil shale has an oxygen concentration that is about the same as the oxygen concentration of the hot ignition gas introduced into the retort.

As more and more of the oil shale surface is ignited, the axount of oxygen consumed increases. Thus, the percentage of the fragmented mass surface that is ignited can be determined by withdrawing off-gas from the retort and comparing the concentration of oxygen in the off-gas to the concentration of oxygen in the ignition gas.

Alternatively, if desired, the percentage of the fragmented mass surface that is ignited can be determined by monitoring a plurality of thermocouples spaced across an upper region of the fragmented mass.

Preferably, the concentration of oxygen in the ignition gas is maintained as high as possible to speed up the ignition process, while being sufficiently low so that the concentration of oxygen in off-gas remains below the maximum acceptable concentration. The maximum acceptable concentration of oxygen in off-gas from the retort is less than the lower explosive limit. This limit for oxygen concentration depends on the composition of the off-gas which can contain various concentrations of carbon monoxide, hydrogen, methane, and other combustible hydrocarbons and the like. Off-gas from several retorts may be comingled and such combustibles are essentially always present; hence, the composition is maintained below the lower explosive limit of such off-gas by controlling oxygen concentration in off-gas from a retort being ignited. The maximum acceptable concentration of oxygen in the off-gas can be appreciably below the lower explosive limit to provide a safety margin against developing a hazardous condition.

Additional details of processes for igniting a fragmented mass surface in an in situ oil shale retort can be found in U.S. Pat. application Ser. No. 389,847, filed on June 18, 1982, by Frederick Michael Gragg, Carl LeRoy Jacobson, and myself. Application Ser. No. 389,847 is incorporated herein by this reference.

During ignition, as the percentage of the fragmented mass surface that is ignited increases, the percentage of oxygen in the ignition gas is preferably increased. Such increasing of oxygen in the ignition gas speeds up ignition and can be done in steps or continuously as desired. This portion of the ignition process is called the oxygen step-up phase.

After it is determined that the combustion zone is spread as desired across the fragmented mass surface (based either on temperature readings from the array of thermocouples or on the concentration of oxygen in retort off-gas falling to about zero), the burner is extinguished.

Air is then introduced into the retort through one or more of the boreholes 36 or through the drift 34 and an off-gas is withdrawn from a lower portion of the fragmented mass through the drift 22. The air is preferably at ambient temperature, but air at other temperatures can be used if desired. The air sustains the combustion zone and advances the leading face of the combustion zone downwardly through the fragmented mass. Preferably, introduction of air is continued until the leading face of the combustion zone has advanced sufficiently into the retort so that a heated zone between about 5 and 10 feet thick is formed.

The thickness of the heated zone can be determined by monitoring with thermocouples or by other temperature monitoring means. Alternatively, after developing experience in igniting retorts of known characteristics, heated zone thicknesses can be determined by time rather than by direct measurement of temperature. Parameters of concern include flow rate of the oxygen-supplying gas, particle size and grade of oil shale near the top surface, void fraction, and void fraction distribution in the fragmented mass and the like.

In an exemplary embodiment, when the heated zone has attained a thickness of about 5 feet, air is discontinued into the retort to extinguish the combustion zone and additionally to extinguish combustion of any materials that may have sloughed from the top boundary into the retort and ignited.

After air is discontinued, a cool inert gas is introduced into the void space. The inert gas cools the plenum, including the top boundary of unfragmented formation, to inhibit sloughing. Additionally, the inert gas cools carbonaceous materials comprising the surface region of the fragmented mass, i.e., the top portion of the heated zone and materials that may have sloughed into the retort. Introduction of the cooling gas is preferably continued until such carbonaceous materials are cooled to below about 550° F., i.e., to below the self-ignition temperature of such materials. For purposes of exposition herein, the terms "surface region of the fragmented mass" and "top portion of the heated zone" include the top 1–2 feet or so of the fragmented mass. Thus, the top 1–2 feet of the heated zone are cooled sufficiently so that they will not re-ignite when contacted by an oxygen-supplying gas.

It is preferable that the cool inert gas introduced into the retort be less than 400° and, more preferably, less than about 300°, to reduce the cooling time. If desired, however, inert gases at higher temperatures can be used.

It is preferable that the heated zone attain a thickness of from about 5 to 10 feet before the oxygen-supplying gas is discontinued so that, after the top portion of the heated zone is cooled, a sufficient amount of carbonaceous materials remain in a bottom portion of the heated zone for efficient re-ignition of the combustion zone. Additionally, if oxygen-supplying gas is continued until the heated zone is greater than about 10 feet thick, the top boundary of the retort is maintained at undesirably high temperatures longer than necessary. This increases sloughing of material into the retort.

If desired, however, heated zones having thicknesses less than about 5 feet and more than about 10 feet can be used in practice of this invention.

Preferably, the cool inert gas comprises steam which, at the elevated temperatures present in the retort, can consume carbonaceous materials from both the top portion of the heated zone and from material that may have sloughed into the retort. Consumption of such carbonaceous materials further inhibits re-ignition of the surface of the fragmented mass and the sloughed materials during the following re-ignition step. Preferably, the cool gas comprises from about 10% to about 100% by volume steam. The remaining portion of the inert gas can comprise nitrogen and/or carbon dioxide. Other inert gases can be used if desired.

Introduction of the cool inert gas is discontinued after the top portion of the heated zone is cooled to below 550° F. It has been found that when the top portion of the heated zone is below 550° F., materials that sloughed into the retort have also been cooled below their self-ignition temperature. The temperature of regions of the fragmented mass can be monitored by thermocouples to determine when to discontinue introduction of the inert gas. More practically, however, after experience is gained in igniting similar retorts, time will be used as the criteria.

Air is then re-introduced into the retort for re-igniting the carbonaceous materials that remain above their self-ignition temperature, i.e., to re-ignite a bottom region of heated zone. This re-establishes the combustion zone in the retort.

Continued introduction of the air sustains and advances the combustion zone downwardly through the retort. Combustion gas produced in the combustion zone passes through the fragmented mass to establish a retorting zone on the advancing side of the combustion zone, wherein kerogen in the oil shale is retorted to produce liquid and gaseous products of retorting. The liquid products and off-gas containing gaseous products pass to the bottom of the fragmented mass and are withdrawn through the drift 22. A pump (not shown) is used to withdraw liquid products from the withdrawal drift to above ground. Off-gas is withdrawn by a blower (not shown) and passed to above ground.

The following example of igniting a vertical in situ oil shale retort about 41 feet square and 100 feet high will further illustrate practice of principles of this invention. The retort was similar in construction to the retort shown in the drawing.

A void space or plenum about 10 feet high was between the top surface of the fragmented mass of oil shale particles and the overlying top boundary of unfragmented formation.

A hot ignition gas at about 1600° F. comprising oxygen was introduced into the plenum to ignite the surface of the fragmented mass to thereby establish a combustion zone in the retort. The amount of ignition gas introduced was about 1.14 standard cubic feet per minute per square foot of fragmented mass surface (SCFM/ft$^2$). During the first 21 hours of ignition gas introduction, the oxygen concentration of the ignition gas was about 2% by volume. During the next 16 hours, the concentration of oxygen in the ignition gas was increased in steps to 3% for 5 hours, 7% for 3 hours, 10% for 4 hours, and finally to 13% for the remaining 4 hours. Introduction of the hot ignition gas was then discontinued.

Air at about ambient temperature was then introduced into the plenum for the next 17 hours for sustaining the combustion zone and for advancing the leading face of the combustion zone downwardly through the retort. The rate of air introduction was about 1 SCFM/ft$^2$ for the first 10 hours and was reduced to about 0.62 SCFM/ft$^2$ for the remaining 7 hours. Introduction of air was then discontinued.

During the oxygen step-up phase, the plenum temperature increased from about 640° F. to about 1050° F. During the cold air phase, the plenum temperature peaked at about 1350° F. and, at the time the cold air was discontinued, the plenum temperature had dropped to about 1000° F.

Formation sloughed from the top boundary into the retort during both the oxygen step-up and cold air phases of the ignition process. About 3 feet of the plenum roof sloughed near the center of the retort, while the amount of sloughing decreased outwardly from the center.

Immediately after cold air introduction was discontinued, an inert gas at about 300° F. comprising between about 50 and 70 percent by volume steam, with the remainder comprising nitrogen and carbon dioxide, was introduced into the plenum. Introduction of the inert gas was maintained for about 8 hours at about 1 SCFM/ft$^2$. During this 8-hour period, the temperature of the plenum dropped to about 525° F. During the next 12 hours, the ignition process was stopped and data evaluated.

At the completion of this 12-hour period, the inert gas was then re-introduced into the plenum at the same flow rate and temperature as before. Introduction of inert gas was maintained for 18 hours, during which time the plenum temperature dropped to about 460° F.

Inert gas introduction was then discontinued and air at ambient temperature was introduced into the plenum. Introduction of air re-ignited carbonaceous materials in the fragmented mass that remained above their self-ignition temperature to thereby re-ignite the combustion zone. Introduction of air was continued to advance the combustion zone downwardly through the retort.

Although fragmented formation from the plenum roof sloughed during the oxygen step-up and cold air phases of the process, no roof sloughing was noted during or after cool inert gas introduction.

The above description of a method for igniting an in situ oil shale retort in a subterranean formation containing oil shale is for illustrative purposes. Because of variations which will be apparent to those skilled in the art, the present invention is not intended to be limited to the particular embodiments described above. The scope of the invention is defined in the following claims.

What is claimed is:

1. A method for igniting an in situ oil shale retort in a subterranean formation containing oil shale, such a retort containing a fragmented permeable mass of formation particles containing oil shale and having top, bottom, and side boundaries of unfragmented formation, the method comprising the steps of:

(a) establishing a combustion zone in a top surface region of the fragmented mass in the retort;

(b) advancing the leading face of the combustion zone downwardly through the fragmented mass;

(c) extinguishing the combustion zone;

(d) introducing a cool inert gas into the retort for cooling carbonaceous materials in the top surface region of the fragmented mass to below the self-ignition temperature of such carbonaceous materials while leaving carbonaceous materials in the fragmented mass below the top surface region at temperatures greater than the self-ignition temperature of such carbonaceous materials;

(e) discontinuing introduction of the cool inert gas into the retort; and thereafter (f) introducing an oxygen-supplying gas into the retort for igniting carbonaceous materials located below the surface region of the fragmented mass to thereby re-establish the combustion zone in the fragmented mass below its surface and for advancing the combustion zone downwardly through the retort.

2. The method according to claim 1 wherein the cool inert gas is at a temperature less than about 400° F.

3. The method according to claim 1 wherein the cool inert gas is at a temperature less than about 300° F.

4. The method according to claim 1 wherein the cool inert gas comprises by volume from about 10 percent to about 100 percent steam.

5. The method according to claim 1 wherein the leading face of the combustion zone is advanced downwardly in step (b) a sufficient distance to provide a heated zone in the fragmented mass between about 5 and 10 feet thick.

6. A method for igniting an in situ oil shale retort in a subterranean formation containing oil shale, such a retort containing a fragmented permeable mass of formation particles containing oil shale and having top, bottom, and side boundaries of unfragmented formation, a void space being in the retort between the top surface of the fragmented permeable mass and the top boundary of overlying unfragmented formation, the method comprising the steps of:

(a) introducing a hot ignition gas comprising oxygen into the void space in the retort for heating the top surface of the fragmented mass to above the self-ignition temperature of oil shale to thereby form a combustion zone across the surface of the fragmented mass;

(b) discontinuing introduction of the hot ignition gas;

(c) introducing an oxygen-supplying gas into the void space and withdrawing off-gas from the retort downstream from the combustion zone for sustaining the combustion zone and for advancing the combustion zone downwardly through the fragmented mass;

(d) discontinuing introduction of the oxygen-supplying gas into the retort to thereby extinguish the combustion zone;

(e) introducing a cool inert gas into the retort void space for cooling carbonaceous materials comprising the surface of the fragmented mass to a temperature below the self-ignition temperature of such carbonaceous materials, while leaving carbonaceous materials comprising the fragmented mass below its surface at temperatures greater than the self-ignition temperature of such carbonaceous materials;

(f) discontinuing introduction of the cool inert gas into the retort; and thereafter (g) introducing an oxygen-supplying gas into the retort for igniting the carbonaceous materials below the surface of the fragmented mass to thereby re-establish the combustion zone in the fragmented mass and for advancing the combustion zone downwardly through the retort.

7. The method according to claim 6 wherein the cool inert gas is at a temperature less than about 400° F.

8. The method according to claim 6 wherein the cool inert gas is at a temperature less than about 300° F.

9. The method according to claim 6 wherein the cool inert gas comprises by volume from about 10% to about 100% steam.

10. The method according to claim 6 wherein the combustion zone is advanced downwardly in step (c) a sufficient distance to provide a heated zone in the fragmented mass between about 5 and 10 feet thick.

11. A method for igniting an in situ oil shale retort in a subterranean formation containing oil shale, such a retort containing a fragmented permeable mass of formation particles containing oil shale and having top, bottom, and side boundaries of unfragmented formation, a void space being in the retort between the top surface of the fragmented permeable mass and the top boundary of overlying unfragmented formation, the method comprising the steps of:

(a) introducing a hot ignition gas comprising oxygen into the void space in the retort for heating the top surface of the fragmented mass to above the self-ignition temperature of oil shale to thereby form a combustion zone across the surface of the fragmented mass;

(b) discontinuing introduction of the hot ignition gas;

(c) introducing an oxygen-supplying gas into the void space and withdrawing off-gas from the retort downstream from the combustion zone for sustaining the combustion zone and for advancing the leading face of the combustion zone downwardly through the fragmented mass;

(d) discontinuing introduction of the oxygen-supplying gas into the retort to thereby extinguish the combustion zone while leaving a heated zone in the fragmented mass comprising carbonaceous materials at temperatures higher than the self-ignition temperature of such materials;

(e) introducing a cool inert gas into the retort void space for cooling carbonaceous materials in a top surface region of the heated zone to a temperature below the self-ignition temperature of such carbonaceous materials, while leaving carbonaceous materials in regions of the heated zone below its top surface region at temperatures greater than the self-ignition temperature of such carbonaceous materials;

(f) discontinuing introduction of the cool inert gas into the retort; and thereafter (g) introducing an oxygen-supplying gas into the retort for igniting the carbonaceous materials below the top surface region of the heated zone to thereby re-establish the combustion zone in the fragmented mass and for advancing the combustion zone downwardly through the retort.

12. The method according to claim 11 wherein the cool inert gas is at a temperature less than about 400° F.

13. The method according to claim 11 wherein the cool inert gas is at a temperature less than about 300° F.

14. The method according to claim 11 wherein the cool inert gas comprises by volume from about 10% to about 100% steam.

15. The method according to claim 11 wherein the heated zone provided in step (d) is between about 5 and about 10 feet thick.

16. A method for igniting an in situ oil shale retort in a subterranean formation containing oil shale, such a retort containing a fragmented permeable mass of formation particles containing oil shale and having top, bottom, and side boundaries of unfragmented formation, the method comprising the steps of:

(a) establishing a combustion zone in a top surface region of the fragmented mass;

(b) introducing air at about ambient temperature into the retort upstream from the combustion zone and withdrawing off-gas from the retort downstream from the combustion zone for advancing the leading face of the combustion zone downwardly through the fragmented mass;

(c) discontinuing introduction of air to thereby extinguish the combustion zone; thereafter (d) introducing a cool inert gas into the retort upstream from the top surface region of the fragmented mass for cooling unfragmented formation comprising the retort top boundary and for cooling the top surface region of the fragmented mass to a temperature below the self-ignition temperature of carbonaceous materials remaining in the top surface region of the fragmented mass, while leaving carbonaceous material in regions of the fragmented mass below the top surface region at temperatures greater than the self-ignition temperature of such carbonaceous materials;

(e) discontinuing introduction of the cool inert gas; and thereafter (f) introducing an oxygen-supplying gas into the retort for igniting the carbonaceous materials in the fragmented mass that remain at temperatures greater than their self-ignition temperature to thereby re-establish the combustion zone in a region of the fragmented mass below the top surface region and for advancing the combustion zone downwardly through the retort.

17. The method according to claim 16 wherein the cool inert gas is at a temperature less than about 400° F.

18. The method according to claim 16 wherein the cool inert gas comprises by volume from about 10% to about 100% steam.

19. The method according to claim 16 wherein the unfragmented formation comprising the retort top boundary is cooled to less than about 550° F.

20. The method according to claim 16 comprising introducing air at ambient temperature to advance the combustion zone sufficiently to provide a heated zone of fragmented formation particles that extends from the fragmented mass surface to between about 5 and about 10 feet below the fragmented mass surface.

21. A method for igniting an in situ oil shale retort in a subterranean formation containing oil shale, such a retort containing a fragmented permeable mass of formation particles containing oil shale and having top, bottom, and side boundaries of unfragmented formation, a void space being in the retort between the top surface of the fragmented permeable mass and the top boundary of overlying unfragmented formation, the method comprising the steps of:

(a) introducing a hot ignition gas comprising oxygen into the void space in the retort for heating the top surface of the fragmented mass to thereby form a combustion zone across substantially the entire horizontal extent of the retort;

(b) discontinuing introduction of the hot ignition gas;

(c) introducing air at about ambient temperature into the void space and withdrawing off-gas from a lower portion of the fragmented mass for sustaining the combustion zone and for advancing the leading face of the combustion zone downwardly through the fragmented mass;

(d) discontinuing introduction of air into the retort to thereby extinguish the combustion zone;

(e) introducing an inert gas comprising from about 10% by volume to about 100% by volume steam into the void space for cooling the surface region of the fragmented mass to below about 550° F., while leaving regions of the fragmented mass below the surface region at a temperature greater than about 550° F.; thereafter (f) discontinuing introduction of the inert gas into the void space; and (g) introducing an oxygen-supplying gas into the void space and withdrawing an off-gas from a lower portion of the fragmented mass for re-igniting the regions of the fragmented mass that remain at temperatures greater than about 550° F. and for advancing the combustion zone downwardly through the retort.

22. The method according to claim 21 wherein the inert gas is at a temperature less than about 400° F.

23. The method according to claim 21 wherein introduction of air during step (c) is continued until the combustion zone is advanced sufficiently to provide a heated zone in the fragmented mass between about 5 and about 10 feet thick.

* * * * *